US007664283B2

(12) United States Patent
Ramenzoni

(10) Patent No.: US 7,664,283 B2
(45) Date of Patent: Feb. 16, 2010

(54) DEVICES AND TRANSDUCERS WITH CAVITY RESONATOR TO CONTROL 3-D CHARACTERISTICS/HARMONIC FREQUENCIES FOR ALL SOUND/SONIC WAVES

(75) Inventor: Daniele Ramenzoni, Fidenza (IT)

(73) Assignees: Andrea Chiesi, Parma (IT); Gianandrea Bianchi, Bardi (IT)

( * ) Notice: Subject to any disclaimer, the term of this patent is extended or adjusted under 35 U.S.C. 154(b) by 820 days.

(21) Appl. No.: 11/250,053

(22) Filed: Oct. 13, 2005

(65) Prior Publication Data

US 2006/0090959 A1 May 4, 2006

(30) Foreign Application Priority Data

Oct. 18, 2004 (IT) ..... MI2004A1972

(51) Int. Cl.
*H04R 1/20* (2006.01)

(52) U.S. Cl. ..... 381/345; 381/349

(58) Field of Classification Search ..... 381/345, 381/349, 353

See application file for complete search history.

(56) References Cited

U.S. PATENT DOCUMENTS

| | | | | |
|---|---|---|---|---|
| 2,295,527 | A | 9/1942 | Bowley | |
| 4,379,951 | A | 4/1983 | Gabr | |
| 5,261,006 | A | 11/1993 | Nieuwendijk et al. | |
| 5,461,676 | A | 10/1995 | Hobelsberger | |
| 6,060,293 | A | 5/2000 | Bohr et al. | |
| 6,062,338 | A | 5/2000 | Thompson | |
| 6,135,551 | A | 10/2000 | Linder | |
| 6,175,489 | B1 | 1/2001 | Markow et al. | |
| 6,353,670 | B1 * | 3/2002 | Gasner | 381/96 |
| 2004/0131223 | A1 | 7/2004 | Stiles | |

FOREIGN PATENT DOCUMENTS

| | | |
|---|---|---|
| CN | 1398141 (A) | 2/2003 |
| DE | 3925919 (A1) | 3/1991 |
| EA | 002097 (B1) | 12/2001 |
| FR | 1 527 032 A | 10/1968 |
| FR | 2 627 341 A | 8/1989 |

(Continued)

OTHER PUBLICATIONS

EP Search Report Dated Jun. 25, 2008.

*Primary Examiner*—Brian Ensey
*Assistant Examiner*—Sunita Joshi
(74) *Attorney, Agent, or Firm*—Hedman & Costigan, P.C.; Kathleen A. Costigan

(57) ABSTRACT

The invention concerns an acoustic device with electro-acoustic transducers and with a cavity resonator that provide extreme tri-dimensional to concentrate/diffuse infrasonic, sonic and ultrasonic waves. It also concerns many structural designs in which some models of cavity resonators and all their transducers are appropriately arranged on the basis of the different uses; so doing it is possible to achieve numerous interacting operational set-ups (basic configuration systems) that can be used in the medical sector, in industry or in the home, in entertainment and leisure. Differently to previously known techniques the acoustic device according to this patent is also a highly sophisticated cybernetic apparatus for the reproduction of various tri-dimensional sound fields that are identical to the original ones, or for generating completely new ones. This acoustic device can be compared to a Helmholtz resonator that transmits sound-waves/harmonic frequencies rather than receiving them.

16 Claims, 6 Drawing Sheets

FOREIGN PATENT DOCUMENTS

| | | |
|---|---|---|
| GB | 830281 | 3/1960 |
| GB | 2 149 272 | 6/1985 |
| JP | 57203398 (A) | 12/1982 |
| JP | 58 106989 | 6/1983 |
| JP | 2000-004983 (A) | 1/2000 |
| JP | 2001-190698 (A) | 7/2001 |
| RU | 2162721 (C2) | 2/2001 |
| SU | 1663791 (A1) | 7/1991 |

* cited by examiner

PRIOR ART
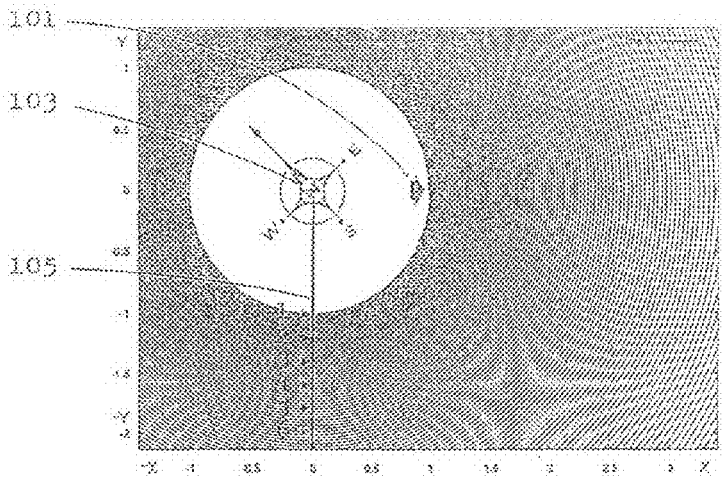
FIG. 1/a
PRIOR ART
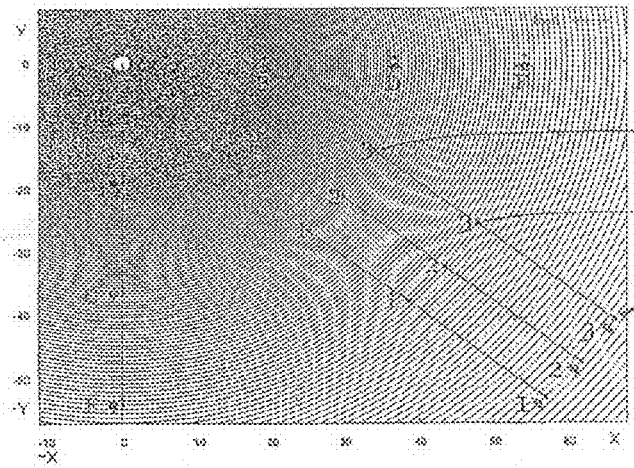
FIG. 1/b
PRIOR ART
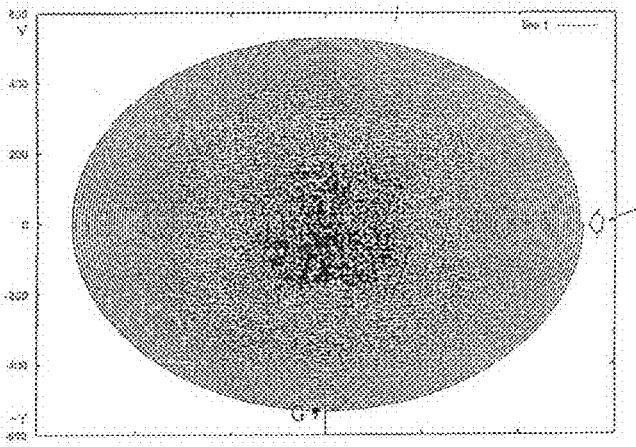
FIG. 1/c FIG. 2/a
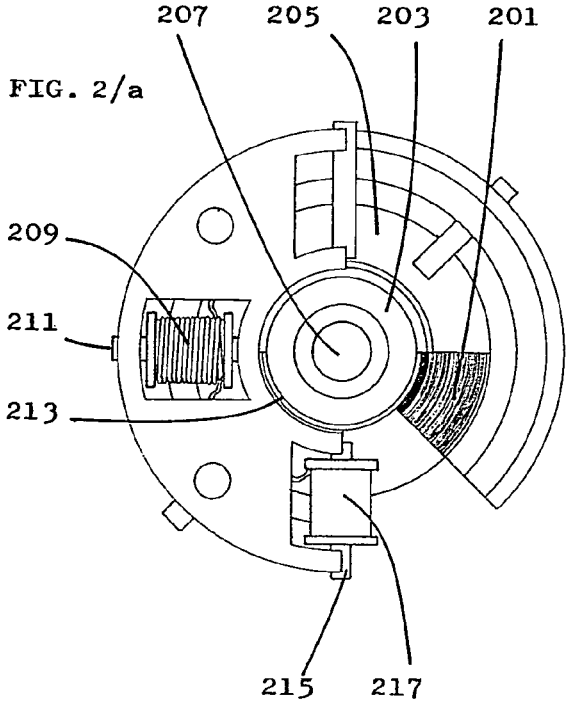
FIG. 2/b
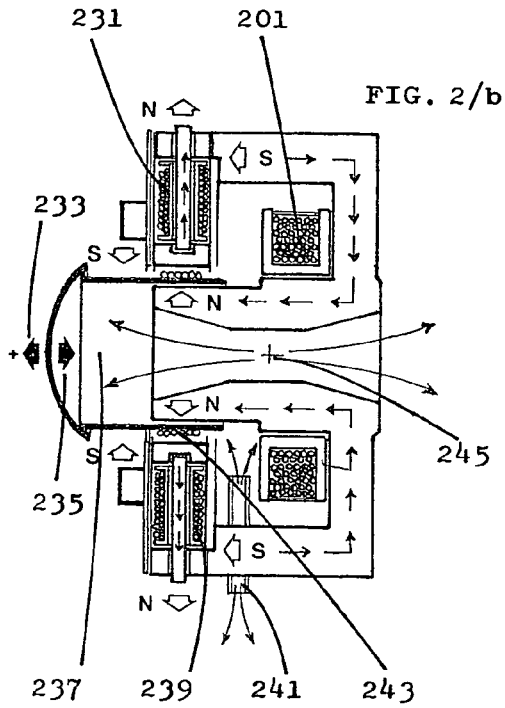
FIG. 2/c
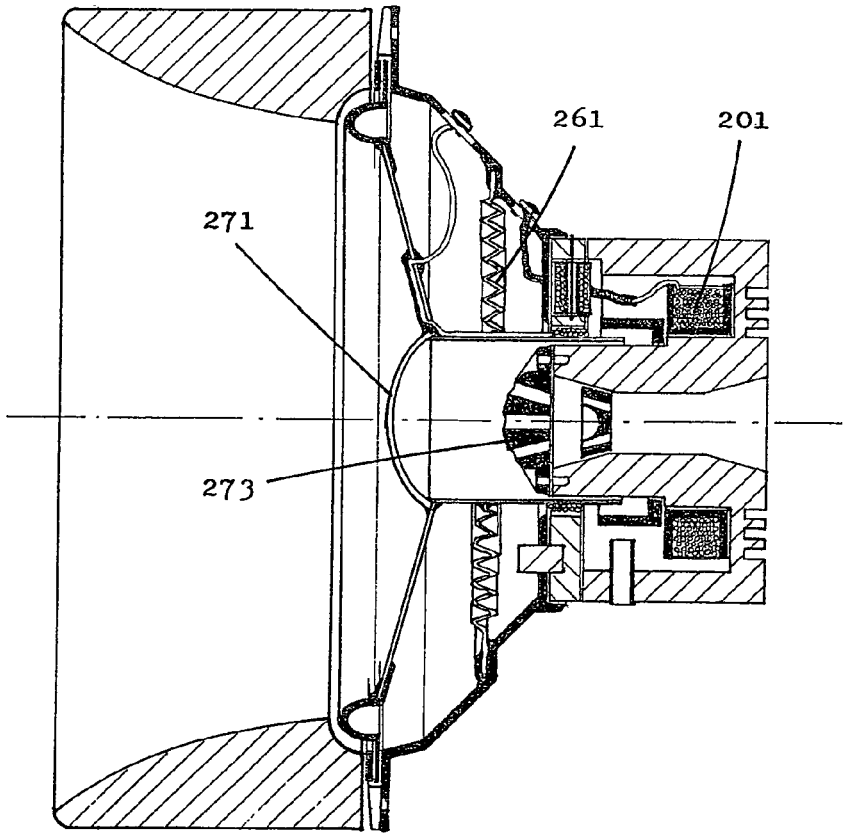

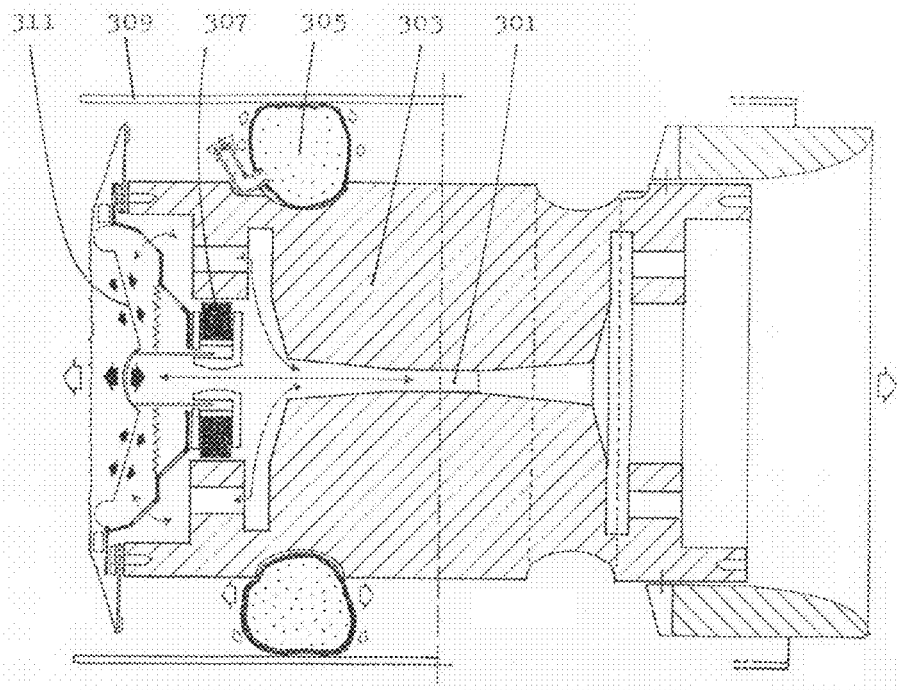
FIG.3/a
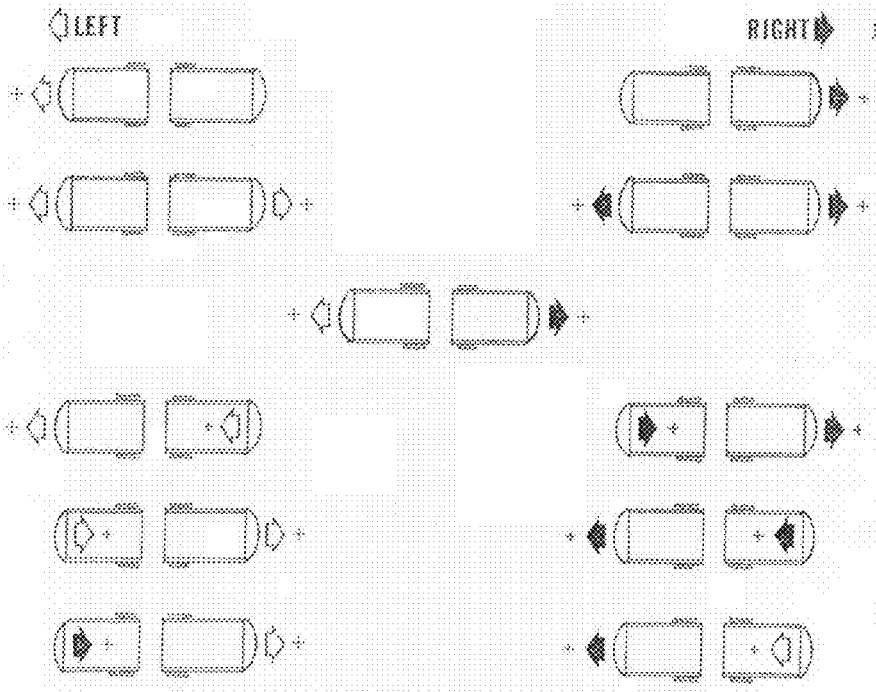
PRIOR ART
FIG.3/b
PRIOR ART
FIG.3/c
FIG.3/d
FIG.3/e
FIG.3/f
FIG.3/g

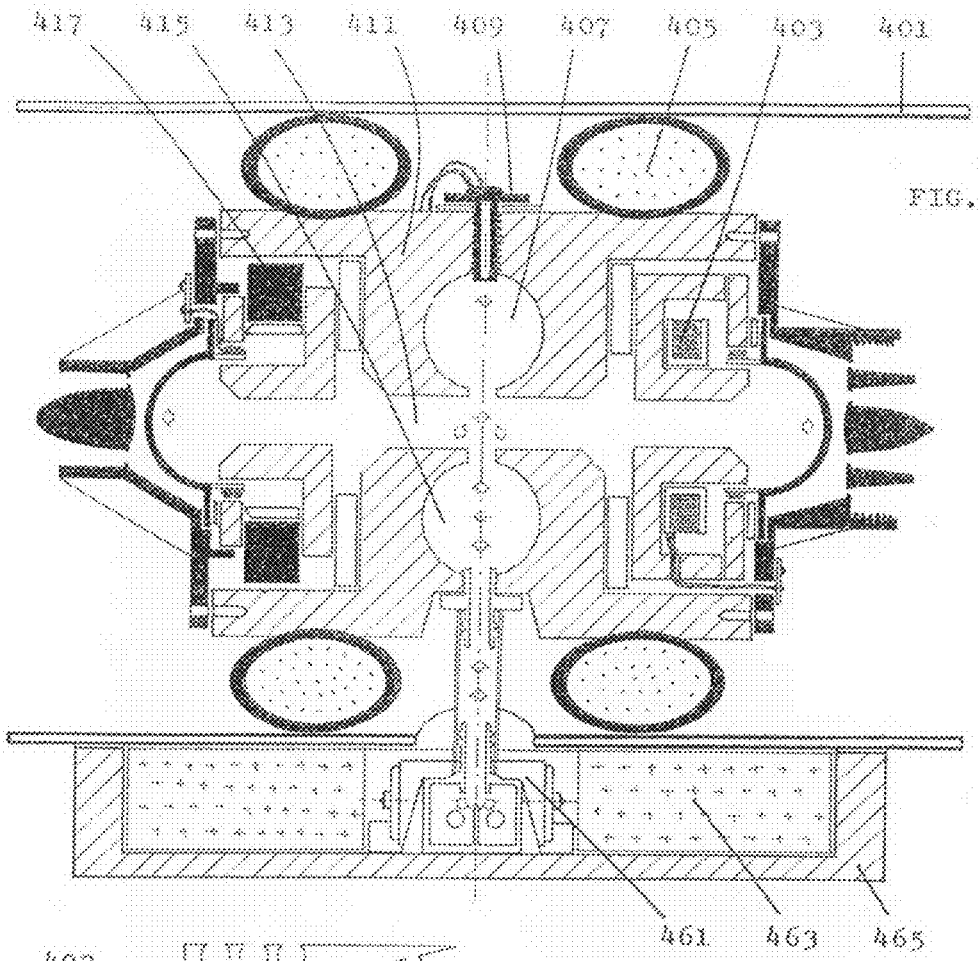
FIG. 4/a
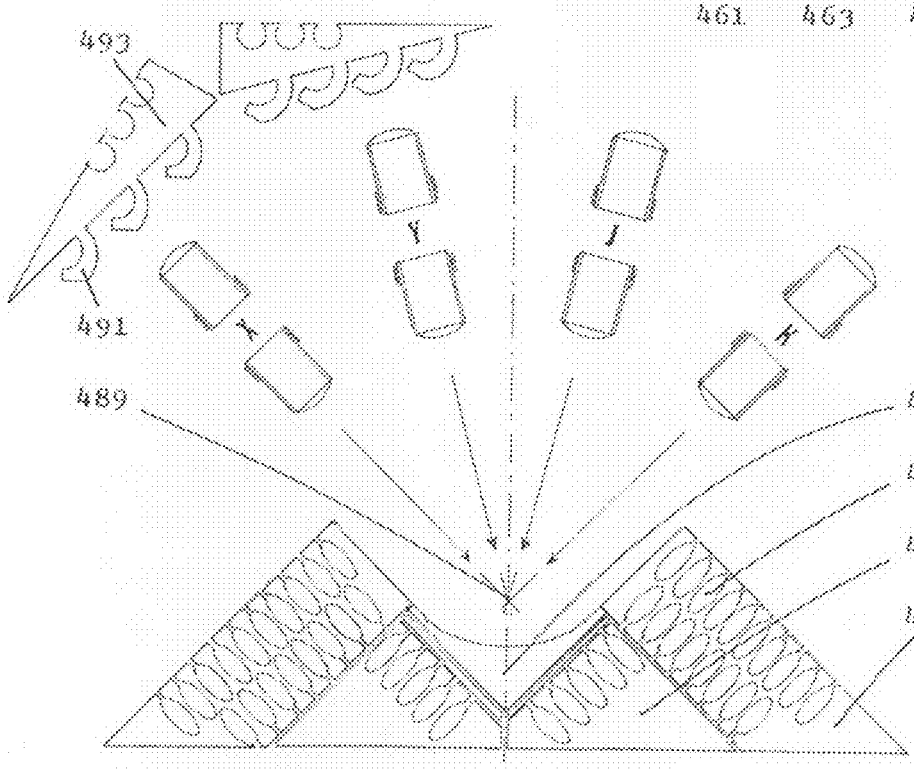
FIG. 4/b

PRIOR ART FIG. 5/a
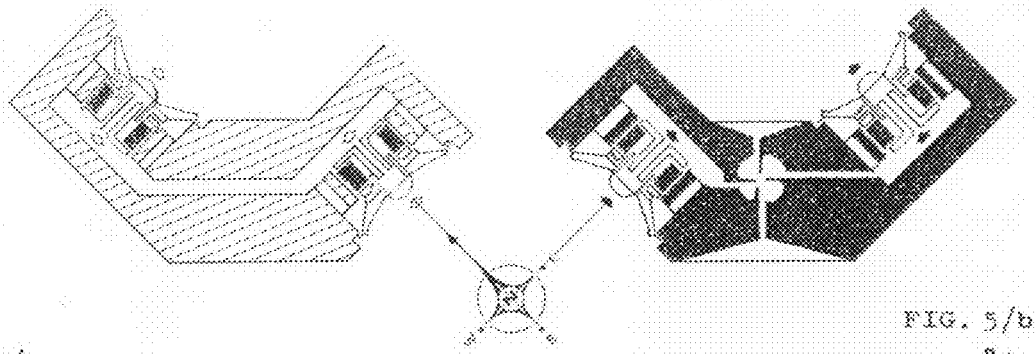
FIG. 5/b
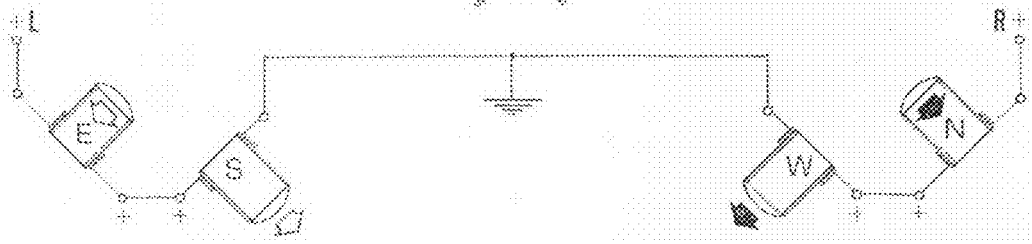
FIG. 5/c
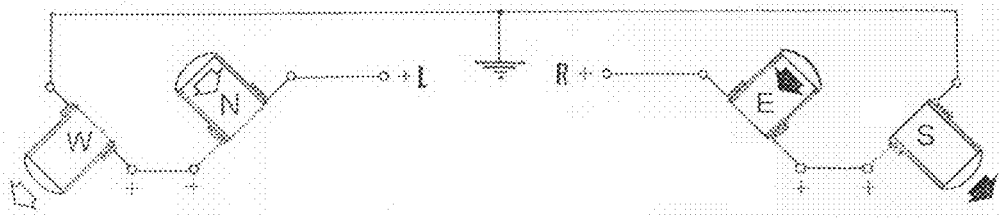
FIG. 5/d
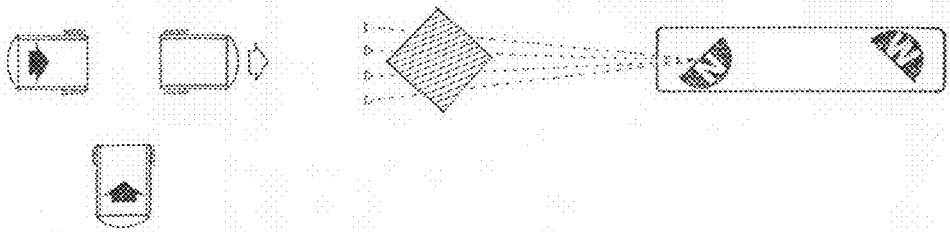
PRIOR ART
FIG. 5/e
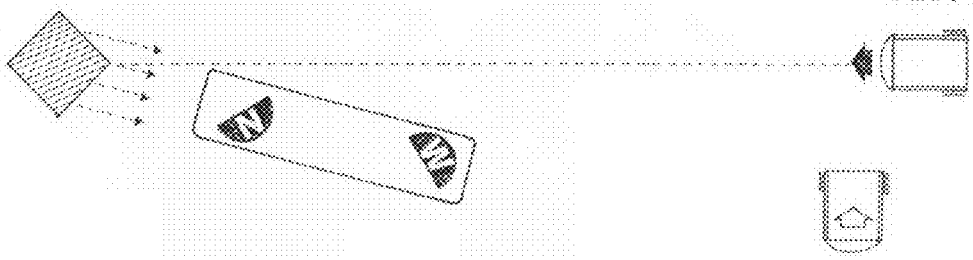

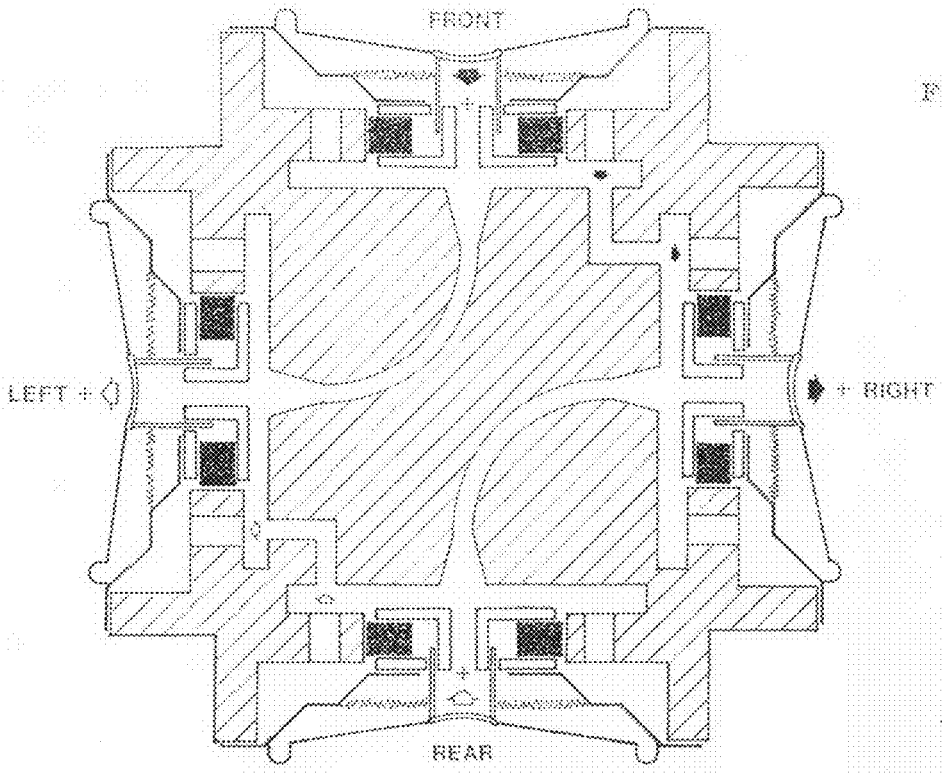
FIG. 6/a
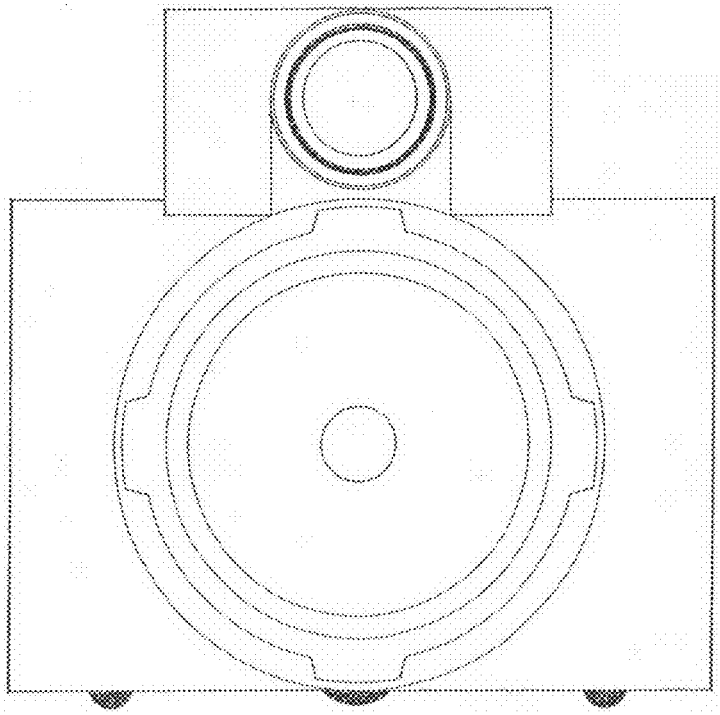
FIG. 6/b

DEVICES AND TRANSDUCERS WITH CAVITY RESONATOR TO CONTROL 3-D CHARACTERISTICS/HARMONIC FREQUENCIES FOR ALL SOUND/SONIC WAVES

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISK

Not Applicable

REFERENCE TO A MICROFICHE APPENDIX

Not Applicable

BACKGROUND OF THE INVENTION

1. Field of the Invention

The invention concerns an acoustic device (and its electric/electronic circuits) having electro-acoustic transducers and a cavity resonator that provide extreme tri-dimensional characteristics (in order to control the main harmonic frequencies but also the fundamental harmonic/overtone in the harmonic series) to concentrate/diffuse infrasonic, sonic and ultrasonic waves. It also concerns many structural designs in which some models of cavity resonators and all their transducers are appropriately arranged and spatially aligned on the basis of the different uses; so doing it is possible to achieve numerous interacting operational set-ups (basic configuration systems) that can be used in many different fields (e.g.: in the medical sector, in industry or in the home, in entertainment and leisure) as illustrated for reference purposes, but in no way restrictive, in the enclosed drawing sheets.

This extremely versatile acoustic device is also a highly sophisticated cybernetic apparatus for the reproduction of various tri-dimensional sound fields that are identical to the original ones, or for generating completely new ones. From these various sound fields, different forms of environmental/surround listening can be obtained, always compatible with the binaural human perception of sound.

This cybernetic apparatus is able to perfectly emulate with superior performances the functions of the human larynx: phonation (the formation of sounds) and respiration (pressure changes and air movements). It is perfectly able to produce beneficial and therapeutic effects on human tissues and human cells that are affected by serious illnesses. The therapeutic effect is not produced from the electro-acoustic energy used but from precise wavelengths (principally from the main harmonic frequencies but also from pure sounds, fundamental harmonics/overtones or first partial) necessary to operate adequately on the ailment.

It is effective due to the stimulating effect it achieves in reactivating and boosting particular brain waves, revealing the acoustic device suitable therefore for the treatment of patients who have trouble or disorder in the production of brain-waves.

The correlation between a stimulus coming from the outside and the patients' own brain waves comes from a theory that is known and proved; this apparatus produces its effect through resonance with delta ($\delta$), theta ($\tau$), alpha ($\alpha$) and beta ($\beta$) brain waves in the frequency band between 0.1 Hz and 30.0 Hz.

The device according to the invention is based on three algorithms: one simulates the two basic components of sound energy with great precision; another emulates and boosts certain phonation characteristics; the third is an algorithm that interacts with the structure of the human brain.

Therefore this acoustic device cannot (in any way) be compared to other existing technologies or other sound systems that derive from mathematical calculations and simulations of environmental acoustic characteristics (i.e.: phase retardation, time delay or experimental tests on sound diffusion through the air in every type of environment).

2. Description of Related Art

In the state of the art of electro-acoustic devices the following patents are cited as references: KR 158885; DE 3925919; KR 1074076; GB 830281; U.S. Pat. No. 6,175,489; EA 2097; JP 57203398; SU 1663791. None of these present analogies, similar characteristics or similar performances; neither are they even vaguely comparable to the acoustic device described in this patent.

In relation to the connection of this device to other devices, with the function of loudspeaker/s, the following patents are cited as reference: JP 2000004983 and TW 514501.

In relation to electro-medical use of this acoustic device the following patents are cited as reference: U.S. Pat. No. 6,060,293; JP 2001190698; CN 1398141; RU 2162721.

Differently to previously known techniques (including those cited as reference), this will become clearer further on, the acoustic device according to this patent, and the basic configuration systems relative to it, make up a cybernetic apparatus among the most sophisticated available today for the reproduction/transmission of sound fields identical to the original (in an extremely realistic/accurate way). The main qualities of the cavity resonator, in the inventive device, are that it works in the same manner as a Helmholtz resonator but, instead of receiving sound/harmonic frequencies, it transmits/diffuses them with their harmonic series. In the inventive device the sonic waves (including infrasonic and ultrasonic waves) and their harmonic series move in a contrary way in respect to the Helmholtz resonator.

It is known that, in the $19^{th}$ century, Hermann Ludwig Ferdinand von Helmholtz (1821-1894) in his research used hollow brass spheres and hollow spherical glass bulbs of various diameter with two diametrically opposite tubular openings: the larger opening was directed towards the sound source to be analysed and the smaller opening was held close to the ear with the better hearing. This instrument was given its inventor's name and is still known today as the "Helmholtz resonator".

In a Helmholtz resonator the sound generated at the source (original sound source) follows a precise route through the two openings of the resonator in order to reach the ear (like a receiver).

SUMMARY OF THE INVENTION

In the cavity resonator of the inventive device the sound/harmonic frequencies go in the opposite direction (like a transmitter) to recreate their original sound source outside the inventive device. In this cavity resonator the wavelengths (this applies to the whole range of wavelengths) choose their route through two openings diametrically opposite each other (see FIGS. 3/*a* and 4/*a*) in order to reach their point of origin (to recreate the original sound source). The direction which is automatically chosen, above all by the harmonic frequencies (rather than the fundamental harmonic) will always be the opposite of that in a typical Helmholtz resonator.

In the inventive device the sound/harmonic frequencies (with their fundamental harmonics) travel in the opposite direction: the whole series of harmonic frequencies (but also the fundamental harmonic/overtone) is created inside the cavity resonator (301, 407, 413, 415) by simply inverting the two voltage feeders (positive pole and negative pole) of the power supply of the fixed solenoid/s (201, 209, 217, 231, 239) of one of the two electro-dynamic drivers (403) that are set opposite each other (in this case the lines of force of the electromagnetic fields generated by the two drivers will be all orientated in the same direction). A similar effect can be obtained by simply inverting the two feeders (inverting the phase) of the electrical input signal of one of the two moving/vibrating coils (243; also see FIGS. 5/*b-c*) in one of the two drivers that are situated opposite one another at 180° at the two extremities of the cavity resonator. This second solution (the inversion of the phase/feeders of the electrical input signal that supplies one of the moving/vibrating coils) is the only one that works when the magnetic fields of the drivers are generated by permanent magnets only (magneto-dynamic drivers; e.g.: 307 and 417).

It is also possible to have applications (FIG. 6/*a*) where each pair of moving/vibrating coils forms an angle of 90° (e.g.: Front with Left, and/or Rear with Right).

The main aim of this acoustic device is to supply sound transducers that can be conveniently used to generate, control, concentrate/diffuse infra-sounds, sounds and ultra-sounds, with the added advantage of being able to direct sound fields, sonic waves, shock waves, acoustic signals, pure sounds, harmonic frequencies, fundamental harmonics, overtones, first partial towards precise points or targets (FIG. 5/*e*).

A second aim is to supply a device that enables the listening/reception of harmonic frequencies, fundamental harmonics/overtones through vibrations/reflections, making them interact with materials. In this case the device offers the advantage of transforming a prefixed percentage of acoustic energy into vibrations/reflections and/or into pressure changes and air movements, and due to this, the peak amplitude of precise wavelengths produces resonating effects on the objects it hits (FIG. 5/*d*). Furthermore medicines/drugs, food products and industrial materials can be analysed and selected by varying the frequency, amplitude (level of penetration) of the sound waves/harmonic frequencies.

A third aim is to supply a device (with relative cavity resonator) designed to interact in a specific way with air particles, water molecules, plant and animal cells, but above all with living human cells for therapeutic and diagnostic means (FIG. 4/*b*).

A fourth aim is that of supplying devices with low production costs in order to associate them with objects/appliances for everyday use.

A fifth aim is that of supplying a small device (even extremely small) able to produce a clearly superior sound output in comparison with traditional devices of equal dimensions already in use today.

Another aim of this device is that of supplying cybernetic applications (see examples: FIGS. 5/*a-b-c*) with the function of emulating and boosting several characteristics of the human voice (both male and female).

A further aim of the invention is to supply a device where the cavity resonator and its transducers can be "tuned" during assembly in order to transmit different mechanical vibrations/resonance effects at accurately predetermined (harmonic) frequencies.

All of these aims and more (that have not been mentioned) are achieved by the (electro-) acoustic device according to the invention, capable of operating in the atmosphere and under extreme conditions (also in the presence of water, vapour or gases, and in water, by applying certain known precautions) without going beyond this patent.

BRIEF DESCRIPTION OF THE SEVERAL VIEWS OF THE DRAWINGS

FIGS. 1/*a*, 1/*b*, 1/*c* show three diagrams of the same curve on different scales between the abscissa (x) axis and the ordinate (y) axis. Starting with orderly pairs of numbers on the plane (ρ, θ): the first diagram (FIG. 1/*a*) shows the initial part (101) of the typical curve; the second diagram (FIG. 1/*b*) shows the constant velocity (k) of point (P) on the spiral (131, 133, 135); the third diagram (FIG. 1/*c*) shows the position where the spiral has been interrupted (161).

FIGS. 2/*a*,2/*b* and 2/*c* show an example of electro-dynamic driver with various electric coils/fixed solenoids (201, 209 and 217 in FIG. 2/*a*); where the electromagnetic circuit is schematised (FIG. 2/*b*), and with the sections of various fixed coils/solenoids (201, 231 and 239); with the exponential loudspeaker (acoustic radiator/diffuser) added to the electro-dynamic driver (FIG. 2/*c*).

FIG. 3/*a* shows an example of cavity resonator (301, 303) with only one electro-acoustic transducer (magneto-dynamic driver).

FIG. 3/*b* to FIG. 3/*g* show six arrangements (basic configuration systems) achieved by inversion of the phase/feeders of the electrical input signal/channel that supplies different moving/vibrating coils: Left input channel=White arrow/Right input channel=Black arrow (where the movements of the coils can be: in phase="air suction"=external arrow/inverted phase="air compression"=internal arrow).

FIG. 4/*a* shows a second example of cavity resonator (407, 411, 413, 415) which is suitable for electro-medical use with two electro-acoustic transducers that are situated opposite one another at 180° at the two extremities of the cavity resonator. The magnetic fields of the two drivers are generated by permanent magnets/magneto-dynamic driver (417) and by (electromagnetic) coils/electro-dynamic driver (403).

FIG. 4/*b* shows four of these types of acoustic devices ("X", "Y", "J", "K") in a schematic with their sonic beams (acoustic waves/harmonic frequencies) concentrated on a sliding bed.

FIG. 5/*a* shows a third example, in section, of a cavity resonator in which the Right acoustic device has been constructed to be inversely congruent with its symmetric Left twin.

FIGS. 5/*b* and 5/*c* show two electrical circuits (FIGS. 5/*b*, 5/*c*) having two different methods for connection of the two acoustic devices in FIG. 5/*a* to the Left/Right channels.

FIGS. 5/*d* and 5/*e* show typical industrial applications where electro-acoustic transducers (with a cavity resonator) are coupled to a "RESONATOR DEVICE AND CIRCUITS FOR 3-D DETECTION" of Patent WO 2003/079725.

FIG. 6/*a* shows a section of a cavity resonator having four drivers arranged at 90° angles to each other.

FIG. 6/*b* discloses several acoustic devices (and therefore audio channels) grouped together in a single position.

DETAILED DESCRIPTION OF THE INVENTION

1) Magnetic Circuits and Drivers

The electro-dynamic drivers must be able to magnetise and demagnetise themselves rapidly in relation to the activation/deactivation of the solenoids, therefore a low cost and easy to use material such as soft iron or mild steel and ferrite is used. It is convenient to provide for the use of fixed coils which will make the use of the ring (261), in corrugated material, superfluous.

The presence of only four fixed coils may cause problems, therefore it is advisable to use a microprocessor in order to adjust the input signals, that is connected to the coils which are positioned equidistant to each other (e.g.: 6 coils× 60°=360°).

The parts that must be "transparent" to the magnetic fields can be made from austenitic stainless steel.

The permanent magnet in the magneto-dynamic drivers must generate a high magnetic field (not comparable either in precision or quality to that generated by the solenoids). The most powerful magnets available today are "sintered" metal powders, but they are extremely fragile and therefore have reduced dimensions.

Permanent magnets that are more resistant to vibrations and to shocks, as well as processing, are made from cobalt and samarium, and furthermore they only demagnetise at temperatures above 130° C.

By varying the distances between the permanent magnets a magnetic coupling is created: the greater the distance the weaker the magnetic field; considerable design alterations of these parameters can be made in relations to the use of an soft iron core.

The hysteresis cycle in the permanent magnets must always be put into relation with the physical properties of the materials but also with their geometric shape: a ring shape has practically an almost ideal hysteresis loop.

2) Cavity Resonator

In order to be able to gather the highest amount of information possible from the electric signals that supply the moving (vibrating) coils of the device, it is necessary to control and regulate every physical parameter of the fluid (usually air) that is contained in the cavity resonator.

The temperature can be modified rapidly by using plates and junctions that exploit/utilize the "Peltier effect"; an effect which is easily controlled with microprocessors as the absorption or the production of heat depend on the direction of the current flow that goes through these metal junctions; furthermore there is linearity between cause and effect brought about by the "Peltier coefficient".

In order to obtain a rapid variation or to stabilize pressure, it may be very useful to employ the use of micro-pumps placed on the outside of the device.

The higher internal pressures are obtained by using cavity resonators equipped with the type of drivers in FIG. 4/*a*, Sheet 4/6, because they do not make use of fragile and easily deformed materials as do the acoustic cones of the loudspeakers.

Temperature and pressure sensors are placed in strategic positions.

The cavity resonator corresponds to a resonating circuit in which it is not always possible to clearly distinguish the elements that carry out an inductive function to those that carry out a capacitive function. The electromagnetic field is instead mainly concentrated in proximity of the drivers, particularly in the "gap" where the moving coils vibrate. The electrostatic charges that accumulate on the small metallic caps are a consequence of the rapid movement of the fluid contained in the small vibrating cylinders of the moving coils.

When designing a cavity it is important to "tune" the frequency in accordance with the (d) distance between the moving coils, therefore by increasing the distance the natural frequency of the cavity increases as the capacity reduces. An opposite effect also exists produced by the vibration of air in the sound pipes (e.g.: organ pipe), in fact there is a direct proportion between the length of the cavity (equal to half a wavelength "λ" of the fundamental frequency) and that of the wave of the generated sound and its nodal point (that assumes different positions in time due to the movement of the cylinders that are connected to the moving coils). Another method that can be used to vary the resonance frequency ($f_R$) is that of reducing the inductance by confining as much fluid as possible (normally air) into a duct with a reduced diameter (but if the opening is too small, this will nullify most of the advantages deriving from this technology).

The "core" is supported by adequate air chambers, inflated at low pressure, in order to subdue the vibrations (and not the sonic waves). An adequate mass of the "core" can increase the acoustic quality of the device.

3) Magnetic Flux and Moving/Vibrating Coils

The drivers described above produce a magnetic flux between opposite poles (North vs South) which tends to spread and disperse into the air in the centre of the "gap", therefore the magnetic flux available to the moving coil tends to diminish drastically as the air "gap" increases.

In the presence of a positive (in phase) input signal the moving coil must be able to move away from the central solenoid (electro-dynamic driver) or from the permanent magnet (magneto-dynamic driver) as shown in FIG. 2/*b* (233) therefore it draws in air through the opening in the core of the driver (it draws in air from the resonator); in the presence of a negative input signal the coil must be able to draw closer to the solenoid/central magnet (235).

The core of the resonator device has the function of strengthening the sound and above all it must concentrate the energy inside the structure of the resonator, to then diffuse it towards the outside. The moving coils that are spaced out and set opposite each other, move backwards and forwards as though they were tied/linked to each other by an elastic rod that crosses through the cavity of the resonator.

The use of two or more devices (an even amount is best) gives way to a variety of applications (see examples Sheet 3/6 from FIG. 3/*b* to FIG. 3/*g*), but a perfect solution is that of the example in FIG. 3/*g*, a logic of symmetry also seems to be preferable, as for example: two or four devices that are inversely congruent in shape that rotate in opposite directions until they reach angles of the same amplitude (this application is extremely interesting in the electro-medical field); or devices that are connected either electrically or arranged according to precise axial symmetry; but above all two or four devices connected between themselves and arranged according to a pattern of central symmetry, even starting from a pair of stereophonic channels).

Description of the Basic Theoretical Principles (Algorithms) of the Electro-Acoustic Device According to the Invention The invention originates from several algorithms and it is mainly two of these that make up the object of the patent: one relative to the way that acoustic energy spreads starting from two components, the second with explicit reference to the structure and the work/function carried out by the human larynx and vocal cords. A novel equation, expressed in polar coordinates in the plane, with orderly pairs of real numbers "ρ" and "θ", came from the first of the algorithms, which represents a particular type of logarithmical spiral:

$$\rho = c_s \cdot \left(\tilde{t} + \frac{\tilde{\rho}}{c_s}\right) \cdot e^{\frac{c_s}{\sqrt{k^2 - c_s^2}} \cdot (\vartheta - \tilde{\vartheta})} \quad \text{where } k > c_s \qquad \text{(Formula 01)}$$

$\tilde{t}$, $\tilde{\rho}$, $\tilde{\vartheta}$ refer to a time different to "zero" taken as reference with respects to the origin "O" of the polar coordinates; from Formula 01 one gets the angles expressed in radians:

$$\vartheta - \tilde{\vartheta} = \frac{\ln \frac{\rho}{c_s \cdot \left(\tilde{t} + \frac{\tilde{\rho}}{c_s}\right)}}{\frac{c_s}{\sqrt{k^2 - c_s^2}}} \qquad \text{(Formula 02)}$$

simplified in:

$$n^{\circ} revs = \frac{\ln \frac{\rho}{\tilde{\rho}}}{2\pi \frac{c_s}{k}} \qquad \text{(Formula 03)}$$

Formula 01 may also be simplified in this way:

$$\rho = \rho_o \cdot e^{\frac{c_s}{k} \cdot (\vartheta - \vartheta_o)} \quad \text{valid only with } k \gg c_s \qquad \text{(Formula 04)}$$

This is the definition of the spiral conceived and calculated Ramenzoni: the trajectory of a point P characterized by having a constant radial speed c (with respect to specified polar coordinates in the plane) is characterized by a constant time derivative k of the arc length along the spiral itself, with k>c. The solution to this geometric problem implies an always well defined progressive reduction of the velocity of the point P (whose anti-clockwise rotation direction is considered positive by convention). In order to carry out simulations it is necessary to have $k \gg c_S$, and therefore the value of the speed of propagation of sonic energy through the medium (or chosen environment) is assigned to the $c_S$ constant, while k can reach values depending on the speed of light in the medium taken as reference.

Application Prospects Derived from the Electro-Acoustic Device According to the Invention (Laboratory Tests)

A) Information Theory "On the Cosmic System" [by Daniele Ramenzoni © 2004]

The theory is that of disposing of an information transmission system starting from two components. We can make the first component correspond to a vector that transmits information at the speed of light, and that has the specific characteristic of joining the transmitter to one of the many possible receivers with an ideal straight line.

The second component differentiates the transmission to each receiver depending on their positions relative to each single transmitter taken as reference.

The information proceeds along a curved trajectory (spiral) resulting in the existence of a variable angle, always slightly inferior to 90°, between this second vector and the fundamental one (the first one). The exact size of this angle allows the determination of the distance from the transmitter and the density of the information travelling on the second vector.

One of the data storage systems invented and in use is a type of spiral whose pace is always the same and this happens in such a way to make the best use out of all the space available on the flat support. From the need in the cosmic system for having only vectors that proceed at a constant velocity from the need of transferring information onto a "support" without capacity limits, from the need of making a second vector travel on a spiral with an increasing pace . . . , one deduces that the ideal form of communication for a cosmic transmitter can only have the following equation in polar co-ordinates on the plane:

$$\rho = \tilde{\rho} \cdot e^{\frac{c_L}{k} \cdot (\vartheta - \tilde{\vartheta})} \quad \text{valid only with } k \gg c_L \qquad \text{(Formula 05)}$$

If cosmic space were infinite there would be no need to "format" it. Therefore if space is "formatted" this means there is a limit even for this supreme greatness, consequently however reasonable it may seem to believe that the space available is greater than the quantity of information that can travel through it (there are more supports than information to be stored), it appears opportune to suppose the existence of celestial bodies as "erasers of information".

Under the effect of these "erasers" of information, what initially tended towards the infinite will close in to the finite in this way allowing the information, otherwise destined to get confused and lost, to return to being useful again if it is intercepted on the path it follows before reaching its almost complete annihilation. These useful functions are synthetized by the following equation:

$$\tilde{\rho} = \frac{\rho}{e^{\frac{c_L}{k} \cdot (\vartheta - \tilde{\vartheta})}} - c_L \cdot \tilde{t} \quad \text{where } k \gg c_L \qquad \text{(Formula 06)}$$

By means of this equation disturbance noise does not prevail on the rest of the information, furthermore the information transmitted is subject to the dominion of the pace of the spiral which determines the deterioration of the signal regardless of the amount of time that has passed from leaving its origin.

If $c_L$ is made to correspond to the speed of light in space, perhaps k should be considered as a velocity vector which describes a movement of information instead of matter.

If information were distributed on different planes (and not inside a single container having a precise volume) it would be information that is relative to a precise bi-dimensional ambit; and this could be a good thing because there is always the possibility of tuning in (by applying the 90° rule) on different informative planes whilst remaining in the same reception point.

B) Draft for Theory of "The Manifold Planes" [by Matteo Belli and Daniele Ramenzoni © 2004]

In cosmic space there are almost infinite intersections of planes that are very different from one another that take reference from one point of origin (e.g.: a star) or to a point of arrival (e.g.: a black hole). This would allow to speculate on a simple and useful system for measuring co-ordinates for the travelling of great distances.

The passage from one reference plane to another occurs through appropriate rotations according to the relative Euler angles and through the knowledge of the equation that describes the trajectory of each new spiral that has been intercepted. In particular the distance between the considered point and the source of the information is defined once the displacement of the 90° angle between the two components that have been intercepted on the plane that are to be taken as a new, valid, reference is known.

The information theory on the cosmic system is also applicable in practice to systems considerably reduced in size, as for example devices for electro-medical use.

Graphic Representation of the Working of the Algorithm of the Spiral Studied by Ramenzoni" (FIGS. 1/*a*, 1/*b*, 1/*c*)

The three figures (FIGS. 1/*a*, 1/*b*, 1/*c*) show the same spiral (on different scales) in which the speed of point P is constant on the radial vector (speed c) and in which the modulus of the velocity projection of point P is also constant on the curve (speed k), and it is necessary to have k>c.

The velocity of the point is obtained from the time derivative of the position (equation of motion), and performing a further time derivative the acceleration is obtained (position, speed and acceleration are vectors, and the anti-clockwise rotation is by convention considered positive).

If speed $c_S$, corresponds to the speed of the propagation of sonic energy in the air ($c_S$=333.3 meters per second at the temperature of approximately +3° C.), the order of magnitude of the units and also, above all, the legibility of the graphic representations that are obtained will depend exclusively on the value of the speed of the k constant. Therefore at least two constant values should be allocated to k (in proportional ratio to one another): one necessary for the calculations, the other verified on the graphic representations (in order to make them understandable and always comparable to the calculations).

FIG. 1/*a* clearly shows the initial part of the spiral (indicated by the large black arrow, in 101) that would otherwise be impossible to see in the scale of FIG. 1/*c*, when the simulation has been interrupted at the point indicated by the large white arrow (161). In FIG. 1/*a* the origin, or "pole", O is fixed by convention (103) at the centre of the four cardinal points (North, West, South, East).

With each increase of a unit of time (increments always of equal value) constant increments on the radius are produced (that is, of identical linear length); such increments are indicated with $\rho_1, \rho_2, \rho_3, \rho_4, \rho_5, \rho_6$ (but only the numbers without the Greek letter "rho" have been shown on the drawing).

Every increment of a round angle of point P on the spiral corresponds to a circular path with the addition of an increment, called "pace" of the spiral: in this curve the pace increases with every round angle, whilst the radial vector in proportion slows down.

This is comparable to an advancement of discrete concentric circles starting from a phase front that moves forward contemporarily performing a circular movement.

Description of Electro-Dynamic Driver (Sheet 2/6)

In FIG. 2/*a* only the static components of the driver are shown, these are to be supplied by direct current and controlled in the best of cases by a microprocessor. The fundamental component that distinguishes this electro-dynamic device from a magneto-dynamic one is shown: the driver. This part mainly consists of the central solenoid, which is made up of innumerable spirals (coils) (201). At least two drivers similar to this must be inserted into a third fundamental organ that makes up the device: the cavity resonator (see FIG. 3/*a* Sheet 3/6). The drivers and the resonator indissolubly make up the "core" of the device that is the subject of this patent.

The driver of this example is made up of at least one main solenoid (201) wound around the core (203), which has a particular central opening (207) in order to obtain an alternating flow of air (245) from the moving coil (243) which makes the small central cap (271) vibrate, through its alternating movements (233 and 235).

In the air chamber under the small metallic cap (237) an accumulation of electric charges is brought about, which is to be correlated to the working of the device through the nozzles made in a particular form (273); but these parts must allow for modification.

FIG. 2/*b* shows the magnetic circuit (electromagnetic, if generated from one or more electric currents). The moving coil is by convention considered subject to in phase current when the cylinder and the relative protection cap receive an upright push due a positive voltage applied to the moving coil.

In the electromagnetic circuit, in FIG. 2/*b*, the main solenoid (201) can be boosted by at least four fixed coils (two have been sectioned in 231 and in 239), opportunely distributed on the circumference (see 209 and 217 in FIG. 2/*a*), that consent perfect control of the magnetic flux coming from the poles (North and South); without these support coils, that with their core (211 and 215) are able to increase and concentrate the lines of force in the desired positions, the magnetic flux would tend to disperse starting from the centre of the ring-shaped "gap" (213). All the coils, either together or independently, are supplied by direct current.

By interchanging the two supply terminals of all the coils (of the central ones, and of those placed on the circumference of the ring-shaped "gap") all the North and South polarities indicated in the electromagnetic circuit (FIG. 2/*b*) are inverted, the positive movement of the cap is also inverted (233), and this will no longer correspond to the expansion phase but to the compression phase (235). These multiple regulation modes are impossible to obtain with the permanent magnets that make up the magneto-dynamic drivers.

FIG. 2/*c* shows a cross-section of two fundamental parts of the device: driver and acoustic radiator.

Description of Several Preferred Arrangements of the Electro-Acoustic Device W) in Cybernetic Apparatus (Sheet 3/6)

In FIG. 3/*a* the "core" (303) of the device is shown inserted into a containing "shell" (309). This drawing shows a typical example of a cavity resonator (301) that is also able to emulate the typical characteristics of human phonation; in order to obtain this result the "core" should always be isolated by air-chambers that are inflated at low pressure (305) and protected inside a containing shell. In this example the left driver (307) is of the magneto-dynamic type and this allows for the creation of apparatus of even the smallest dimensions (with high sound output). This type of driver provides medium-low frequencies in relation to the external diameter of the vibrating cone (311).

The imitation of the human voice, even for its directionality, requires the use of two devices built mirror opposite to each other (with axial symmetry), furthermore the four moving (vibrating) coils (two per each of the devices of the type shown in FIG. 3/*a*) must be supplied according to the electrical scheme described in FIG. 3/*g*.

Therefore two examples of this electro-dynamic driver, complete with acoustic radiator, illustrated in FIG. 2/*c* (Sheet 2/6), linked together by a cavity resonator make up one of the two parts (mirror opposite through axial symmetry) that are necessary for a highly accurate reproduction of the effect that the larynx creates in the trachea through the movement of four membranous strands said "vocal cords". These elastic membranous strands mirror each other as they are arranged two on the left and two on the right with respects to the larynx and the human body. In order to provide a precise description of the effects produced by the magneto-dynamic circuit on the vibrating organ (constructed starting from the moving coils) all the parts that are superfluous to this type of graphic representation, which is valid for both electro-dynamic and magneto-dynamic drivers, have been eliminated from the drawings (of FIGS. 3/*b*, 3/*c*, 3/*d*, 3/*e*, 3/*f*, 3/*g*).

The examples from FIG. 3/*b* to FIG. 3/*f* show that one single device can imitate any other system existing today, with the added advantage that the annoying effect of the "presence" of loudspeakers will no longer exist, this is also influenced by the type of material used.

Furthermore to show that a single two-driver device (example in FIG. 3/*d*) can be considered as part of an expandable diffusion system according to application needs, the hypothesis of also varying the polarity of the power supply to each pair according to its corresponding mirroring twin has been taken into consideration (examples FIGS. 3/*b-c-d-e-f-g*).

In order of importance (from one to six stars):

FIG. 3/*b*: Simulates a traditional stereophonic system, but in this case the sounds reproduced are not conditioned by the construction materials (*).

FIG. 3/*c*: Simulates traditional stereophony, in fact the spatial reproduction of the sounds still depends upon the position of the listener (**).

FIG. 3/*d*: Stereophonic effect reproduced with clear improvement of the spatiality with respects to the preceding case (***).

FIG. 3/*e*: Excellent spatiality but mainly diffused towards the exterior (****).

FIG. 3/*f*: Perfect spatial reproduction from any listening position both in "stereo" and "multi-channel", always using one transducer per channel (*****).

FIG. 3/*g*: Almost always perfect tri-dimensional representation (******) even starting from a single device but connected to two "stereophonic" channels, with absolutely perfect reproduction from multi-channel systems (by sending two different channels to each device). This example is the most important because each of the (mirroring) pairs reproduce the working principles of the two tubes set opposite each other of the Helmholtz resonator: therefore only from this type of configuration (either taken singularly or set in a mirroring two-channel system as in this example) is the diffusion of tri-dimensional sound obtained starting from each cavity resonator.

X) For Electro-Medical Applications (Sheet 4/6)

FIG. 4/*a*: Device suitable for generating even high frequencies because the diffusion cone has been eliminated to leave space for a special vibrating protection cap which is connected to a corresponding vibrating coil that can be supplied by either magneto-dynamic drivers (417) or electro-dynamic ones (403) even in the presence of a pump (461), which compresses the fluid in the cavities of the resonator. This pump can be controlled by a microprocessor by means of one or more pressure and temperature sensors (illustrated in the drawing with a single control device, in 409).

FIG. 4/*b*: Shows a schematised plan of a typical surgery equipped for therapy with both concentrated and diffused sound waves; in this example all four devices (similar to that shown in FIG. 4/*a*) concentrate the wave beam that they have generated in one single point (489), in this way creating an application for therapeutic purposes; the electro-medical equipment is completed by an electrically commanded bed (487), and by special sound-absorbent or reverberating panels.

In fact, with complex apparatus that employ more than two cavity resonators, components such as materials with active sound-absorbent shape are indispensable (493), with numerous vibrating absorbers/attenuators (491) appropriately dimensioned with respect to the lengths of the waves used, also the materials with reverberating shape (481 and 483) for their internal cavities (485) that are similar in shape (with different dimensions) to those of the cavity resonators to which they will be applied (inside transmitters/concentrators of sound/sonic waves).

FIG. 4/*a* shows an electro-medical device which is particularly suitable for containing; very particular and elaborate resonating cavities, internal temperature and pressure control devices and sensors for measuring these parameters in relation to the perfect air-tight closure that is obtained with the moving coils without the vibrating cone.

Y) In the Civil and Industrial Acoustics Field (Sheet 5/6)

FIG. 5/*a* shows an extremely sophisticated listening device which is the most accurate available today for reproducing sounds of any nature recorded with the transducer (and accordingly pertains to the prior art) for tri-dimensional reception of sound/sonic waves described and cited in the international patent "RESONATOR DEVICE AND ASSOCIATED CIRCUITS" (published with number WO 2003/079725 in the inventor's name).

This same pair of sound diffusers (mirroring through axial symmetry) can be connected differently to the output of the amplifiers as shown in FIG. 5/*b* for concentrating sounds towards two central sound fields (indicated as Front and Rear) or, as shown in FIG. 5/*c*, diffusing them in every direction starting from any desired position without varying the (electric/electronic) internal circuits. FIG. 5/*d* shows, in a very schematic way, an industrial application for the detection and/or testing of materials, even of large dimensions, these should be placed or made to pass through a pre-fixed area (having a precise distance according to the wavelength) between the transmitter and the receiver.

In FIG. 5/*e* another possible configuration is described achieved by coupling with the receiver of WO 2003/079725 (FIG. 12 Sheet 5/5 of that patent), where that receiver is inserted between the transmitter and the objects to be tested/analysed (which could be moving).

Z) Design/Plan Variations of the Electro-Acoustic Device According to the Invention (Sheet 6/6)

The example in FIG. 6/*a* highlights the fact that two acoustic radiators that make up a pair can form an exact angle of 90° employing a cavity resonator suitable for that purpose.

This type of solution eliminates any type of defect that occurs in all other low frequency listening equipment on the market today, while working with f<300 Hz.

Furthermore this example shows in an unmistakable way the advantage of a tower arrangement, one above the other, of several sound diffusion devices, as illustrated in FIG. 6/*b*, without losing listening quality.

CONCLUSIONS

In the case of old monophonic transmissions/recordings, as in more recent stereophonic or multi-channel ones, tri-dimensional listening is always guaranteed, even if there is only one transducer, with any of the devices described in FIGS. 3 to 6.

The multi-channel systems above all seem to be the most heavily penalized by the comparison with this revolutionary technology (in particular see relative drawings and descriptions on Sheet 3/6).

These are the acoustic parameters that have been taken as reference: perfect sound, dynamics, clearness, recognizability, realistic and correct positioning of the source, etc., together with the extraordinary freedom on behalf of the listener of being able to listen to any type of sound from any desired position (the effect is so realistic that it leads the listener to believe that the acoustic device of this patent is not switched on at all but that the sound is coming from a live source).

For impeccable listening of sound recordings carried out with 3-D receivers shown in patent WO 2003/079725 (Sheet 1/5 and 2/5 of that patent), reference can be made to diffusers that are mirror images that are positioned opposite one another through axial symmetry (as in FIG. 5/*a* Sheet 5/6) that achieve a tangible increase in sound performance, with respects to the traditional types. This acoustic device allows for several types of electric connection with the amplifiers and also various position possibilities of the diffusers in the environment: in the two examples in FIGS. 5/*b* and 5/*c* the electric connection inside each of the diffusers has remained unchanged but the Left=L and Right=R channels have been connected in different ways, in the first case the best solution for the listener is to position himself/herself between the diffusers (scheme in FIG. 5/*b*) or, in the second case, the best solution for the listener is to position himself/herself outside the area between the two diffusers (scheme in FIG. 5/*c*).

For some diffusers the use of the containing "shell" or "tube" illustrated in FIG. 3/*a* Sheet 3/6 (309) and FIG. 4/*a* Sheet 4/6 (401) is not necessary. With the addition of this containing body the cavity resonator is able to vibrate freely because it is exclusively supported by the air chambers (305 and 405) that have been inflated (at low pressure); but other types of shock absorbers may also be used.

INDUSTRIAL APPLICABILITY

The extraordinary characteristics of the device described above make it particularly suitable for working as the main component in electro-medical equipment. Remarkable cuts on construction costs can be obtained by using permanent magnets.

The invention claimed is:

1. An acoustic device for injecting acoustic energy, and generating electromechanical resonance sounds for use in cybernetics, therapeutic and laboratory applications, and transmitting, concentrating and diffusing tri-dimensional acoustic signals in an atmosphere, fluids and in a human body, wherein said device comprises a modular unit for transmitting infrasonic, sonic and ultrasonic waves and signals, said modular unit including a reversible polarity power supply and at least a cavity resonator having a hollow resonating mass body and inlet and outlet openings, said hollow mass resonating body containing a stabilized temperature and pressure fluid, said modular unit further comprising a plurality of drivers with magnetic field generators for driving hollow core electro-acoustic transducers, said magnetic field generators generating magnetic fields with bidirectionally directed force lines.

2. An acoustic device, according to claim 1, wherein said inlet and outlet openings comprise more than one inlet opening and more than one outlet opening, and wherein said cavity resonator is so arranged and constructed that said waves and signals are diffused from one or more of said inlet openings to one or more of said outlet openings or vice-versa.

3. An acoustic device, according to claim 1, wherein said device further comprises acoustic radiator means and adjusting means for each said driver, thereby transforming into vibrations, in said cavity resonator, a selected percentage of an acoustic energy of said sound waves and signals, to make points of maximum positive or negative amplitude of said sound waves and signals to coincide with pre-fixed zones on pre-fixed targets.

4. An acoustic device, according to claim 1, wherein said cavity resonator is made of materials absorbing or reverberating acoustic and harmonic frequency wave energy.

5. An acoustic device, according to claim 1, wherein said plurality of drivers comprise two or more drivers arranged in said cavity resonator to form a single hermetically sealed body, each said driver being coupled to an acoustic radiator for concentrating or diffusing infra-sounds, sounds and ultrasounds even as pulses or shock waves, each said driver including one or more solenoids and at least one movable coil having a hollow perforated core, each said hollow perforated core being subjected to said generated magnetic field through said inlet and outlet openings.

6. An acoustic device, according to claim 1, wherein said magnetic field generators comprise either permanent magnet or electro-dynamic drivers including solenoids supplied by either a DC or a pulse current.

7. An acoustic device, according to claim 6, wherein said drivers are combined dynamic drivers coupled to said cavity resonator at a plurality of connection points comprising permanent magnets and electric magnets, each said driver having at least a hollow core for each said connection point to said cavity resonator.

8. An acoustic device, according to claim 1, wherein each said driver is separated from an adjoining driver, each said driver and said adjoining driver forming a driver pair, by a separating distance from a minimum of 0.1 cm to a maximum of 334 cm.

9. An acoustic device, according to claim 1, wherein said fluid in said cavity resonator has a fluid pressure equal to, lower or higher than an atmospheric pressure and has a temperature from −25° C. to +70° C.

10. An acoustic device, according to claim 1, wherein said device further comprises a plurality of preamplifiers connected to said drivers or transducers, and a corresponding plurality of amplifiers, said pre-amplifiers and amplifiers being power supplied by DC low voltage feeders connected to corresponding power supply apparatus, and being each connected to a single channel.

11. An acoustic device, according to claim 1, wherein said drivers or transducers are miniature drivers or transducers.

12. An acoustic device, according to claim 1, wherein said drivers are connected to each other either opposite one another on a same axis or at equal angles on a same plane, and wherein a left driver of said drivers is precisely mirror-like arranged opposite to a right driver of said drivers.

13. An acoustic device, according to claim 12, wherein said drivers are arranged at 90° from one another inside said cavity resonator.

14. An acoustic device, according to claim 1, wherein said acoustic device provides an acoustic energy distribution based on the following relationship $$\rho = c_s \cdot \left(\tilde{t} + \frac{\tilde{\rho}}{c_s}\right) \cdot e^{\frac{c_s}{\sqrt{k^2 - c_s^2}} \cdot (\theta - \tilde{\theta})} \quad \text{where } k > c_s \qquad \text{(Formula 01)}$$

said relationship defining a geometric logarithmic spiral expressed in polar coordinates in a plane, with orderly pairs of real number "ρ" and "θ", in which the trajectory of a point on said spiral is followed with a constant radial speed c, and a constant time derivative k of an arc length along said spiral.

15. An acoustic device, according to claim 7, wherein said magnetic field generators generate magnetic fields having magnetic field lines of force all oriented on a same direction, and wherein said cavity resonator is a Helmholtz cavity resonator construction-wise similar to a known Helmholtz resonator but so arranged and driven as to operate in a manner reversed with respect to a conventional operation of said known Helmholtz resonator.

16. An acoustic device, according to claim 1, wherein said device further comprises a sound absorbent liner and at least a sound reverberating element.

* * * * *